US006854532B2

(12) United States Patent
Fincher et al.

(10) Patent No.: US 6,854,532 B2
(45) Date of Patent: Feb. 15, 2005

(54) SUBSEA WELLBORE DRILLING SYSTEM FOR REDUCING BOTTOM HOLE PRESSURE

(75) Inventors: Roger W. Fincher, Conroe, TX (US); Roland May, Celle (DE); Peter Fontana, Houston, TX (US); Larry Watkins, Houston, TX (US); James W. Macfarlane, Katy, TX (US)

(73) Assignee: Deep Vision LLC, Houston, TX (US)

( * ) Notice: Subject to any disclaimer, the term of this patent is extended or adjusted under 35 U.S.C. 154(b) by 0 days.

(21) Appl. No.: 10/716,106

(22) Filed: Nov. 17, 2003

(65) Prior Publication Data

US 2004/0124008 A1 Jul. 1, 2004

Related U.S. Application Data

(63) Continuation of application No. 10/094,208, filed on Mar. 8, 2002, now Pat. No. 6,648,081, which is a continuation of application No. 09/353,275, filed on Jul. 14, 1999, now Pat. No. 6,415,877.

(60) Provisional application No. 60/108,601, filed on Nov. 16, 1998, provisional application No. 60/101,541, filed on Sep. 23, 1998, provisional application No. 60/092,908, filed on Jul. 15, 1998, and provisional application No. 60/095,188, filed on Aug. 3, 1998.

(51) Int. Cl.[7] ..... E21B 7/12; E21B 21/08

(52) U.S. Cl. ..... 175/5; 175/25; 175/38

(58) Field of Search ..... 175/5, 7, 25, 48, 175/38, 217; 166/368

(56) References Cited

U.S. PATENT DOCUMENTS

| | | | | |
|---|---|---|---|---|
| 3,603,409 A | 9/1971 | Watkins | ..... | 175/7 |
| 3,815,673 A | 6/1974 | Bruce et al. | ..... | 166/0.5 |
| 4,063,602 A | 12/1977 | Howell et al. | ..... | 175/7 |
| 4,091,881 A | 5/1978 | Maus | ..... | 175/7 |
| 4,099,583 A | 7/1978 | Maus | ..... | 175/7 |
| 4,134,461 A | 1/1979 | Blomsma | ..... | 175/9 |
| 4,149,603 A | 4/1979 | Arnold | ..... | 175/7 |

(List continued on next page.)

FOREIGN PATENT DOCUMENTS

EP 0289250 A2 9/1988

*Primary Examiner*—Frank Tsay
(74) *Attorney, Agent, or Firm*—Madan, Mossman & Sriram P.C.

(57) ABSTRACT

The present invention provides drilling systems for drilling subsea wellbores. The drilling system includes a tubing that passes through a sea bottom wellhead and carries a drill bit. A drilling fluid system continuously supplies drilling fluid into the tubing, which discharges at the drill bit bottom and returns to the wellhead through an annulus between the tubing and the wellbore carrying the drill cuttings. A fluid return line extending from the wellhead equipment to the drilling vessel transports the returning fluid to the surface. In a riserless arrangement, the return fluid line is separate and spaced apart from the tubing. In a system using a riser, the return fluid line may be the riser or a separate line carried by the riser. The tubing may be coiled tubing with a drilling motor in the bottom hole assembly driving the drill bit. A suction pump coupled to the annulus is used to control the bottom hole pressure during drilling operations, making it possible to use heavier drilling muds and drill to greater depths than would be possible without the suction pump. An optional delivery system continuously injects a flowable material, whose fluid density is less than the density of the drilling fluid, into the returning fluid at one or more suitable locations the rate of such lighter material can be controlled to provide supplementary regulation of the pressure. Various pressure, temperature, flow rate and kick sensors included in the drilling system provide signals to a controller that controls the suction pump, the surface mud pump, a number of flow control devices, and the optional delivery system.

14 Claims, 4 Drawing Sheets

U.S. PATENT DOCUMENTS 4,210,208 A 7/1980 Shanks ..... 166/352
4,291,772 A 9/1981 Beynet ..... 175/5
4,440,239 A 4/1984 Evans ..... 175/5
4,813,495 A 3/1989 Leach ..... 175/6
6,142,236 A 11/2000 Brammer et al. ..... 166/358
6,374,925 B1 * 4/2002 Elkins et al. ..... 175/25
6,484,816 B1 * 11/2002 Koederitz ..... 175/25
6,662,110 B1 * 12/2003 Bargach et al. ..... 702/6
6,684,946 B2 * 2/2004 Gay et al. ..... 166/105

* cited by examiner

SUBSEA WELLBORE DRILLING SYSTEM FOR REDUCING BOTTOM HOLE PRESSURE

REFERENCE TO CORRESPONDING APPLICATIONS

This application is a continuation of U.S. Patent Application 10/094,208, filed Mar. 8, 2002, now U.S. Pat. No. 6,648,081 granted on Nov. 18, 2003, which is a continuation of U.S. application Ser. No. 09/353,275, filed Jul. 14, 1999, now U.S. Pat. No. 6,415,877, which claims benefit of U.S. Provisional Application No. 60/108,601, filed Nov. 16, 1998, U.S. Provisional Application No. 60/101,541, filed Sep. 23, 1998, U.S. Provisional Application No. 60/092,908, filed, Jul. 15, 1998 and U.S. Provisional Application No. 60/095,188, filed Aug. 3, 1998.

BACKGROUND OF THE INVENTION

1. Field of the Invention

This invention relates generally to oilfield wellbore systems for performing wellbore operations and more particularly to subsea downhole operations at an offshore location in which drilling fluid is continuously circulated through the wellbore and which utilizes a fluid return line that extends from subsea wellhead equipment to the surface for returning the wellbore fluid from the wellhead to the surface. Maintenance of the fluid pressure in the wellbore during drilling operations at predetermined pressures is key to enhancing the drilling operations.

2. Background of the Art

Oilfield wellbores are drilled by rotating a drill bit conveyed into the wellbore by a drill string. The drill string includes a drilling assembly (also referred to as the "bottom hole assembly" or "BHA") that carries the drill bit. The BHA is conveyed into the wellbore by tubing. Continuous tubing such as coiled tubing or jointed tubing is utilized to convey the drilling assembly into the wellbore. The drilling assembly usually includes a drilling motor or a "mud motor" that rotates the drill bit. The drilling assembly also includes a variety of sensors for taking measurements of a variety of drilling, formation and BHA parameters. A suitable drilling fluid (commonly referred to as the "mud") is supplied or pumped under pressure from the surface down the tubing. The drilling fluid drives the mud motor and discharges at the bottom of the drill bit. The drilling fluid returns uphole via the annulus between the drill string and the wellbore inside and carries pieces of formation (commonly referred to as the "cuttings") cut or produced by the drill bit in drilling the wellbore.

For drilling wellbores under water (referred to in the industry as "offshore" or "subsea" drilling) tubing is provided at the surface work station (located on a vessel or platform). One or more tubing injectors or rigs are used to move the tubing into and out of the wellbore. Injectors may be placed at the sea surface and/or on the wellhead equipment at the sea bottom. In riser-type drilling, a riser, which is formed by joining sections of casing or pipe, is deployed between the drilling vessel and the wellhead equipment and is utilized to guide the tubing to the wellhead. The riser also serves as a conduit for fluid returning from the wellhead to the sea surface. Alternatively, a return line, separate and spaced apart from the tubing, may be used to return the drilling fluid from the wellbore to the surface.

During drilling, the operators attempt to carefully control the fluid density at the surface so as to ensure an overburdened condition in the wellbore. In other words, the operator maintains the hydrostatic pressure of the drilling fluid in the wellbore above the formation or pore pressure to avoid well blow-out. The density of the drilling fluid and the fluid flow rate control largely determine the effectiveness of the drilling fluid to carry the cuttings to the surface. For such purpose, one important downhole parameter controlled is the equivalent circulating density ("ECD") of the fluid at the wellbore bottom. The ECD at a given depth in the wellbore is a function of the density of the drilling fluid being supplied and the density of the returning fluid which includes the cuttings at that depth.

When drilling at offshore locations where the water depth is a significant fraction of the total depth of the wellbore, the absence of a formation overburden causes a reduction in the difference between pore fluid pressure in the formation and the pressure inside the wellbore due to the drilling mud. In addition, the drilling mud must have a density greater than that of seawater so then if the wellhead is open to seawater, the well will not flow. The combination of these two factors can prevent drilling to certain target depths when the full column of mud is applied to the annulus. The situation is worsened when liquid circulation losses are included, thereby increasing the solids concentration and creating an ECD of the return fluid even greater than the static mud weight.

In order to be able to drill a well of this type to a total wellbore depth at a subsea location, the bottom hole ECD must be reduced. One approach to do so is to use a mud filled riser to form a subsea fluid circulation system utilizing the tubing, BHA, the annulus between the tubing and the wellbore and the mud filled riser, and then inject gas (or some other low density liquid) in the primary drilling fluid (typically in the annulus adjacent the BHA) to reduce the density of fluid downstream (i.e., in the remainder of the fluid circulation system). This so-called "dual density" approach is often referred to as drilling with compressible fluids.

Another method for changing the density gradient in a deepwater return fluid path has been proposed, but not used in practical application. This approach proposes to use a tank, such as an elastic bag, at the sea floor for receiving return fluid from the wellbore annulus and holding it at the hydrostatic pressure of the water at the sea floor. Independent of the flow in the annulus, a separate return line connected to the sea floor storage tank and a subsea lifting pump delivers the return fluid to the surface. Although this technique (which is referred to as "dual gradient" drilling) would use a single fluid, it would also require a discontinuity in the hydraulic gradient line between the sea floor storage tank and the subsea lifting pump. This requires close monitoring and control of the pressure at the subsea storage tank, subsea hydrostatic water pressure, subsea lifting pump operation and the surface pump delivering drilling fluids under pressure into the tubing for flow downhole. The level of complexity of the required subsea instrumentation and controls as well as the difficulty of deployment of the system has delayed (if not altogether prevented) the practical application of the "dual gradient" system.

SUMMARY OF THE INVENTION

The present invention provides wellbore systems for performing subsea downhole wellbore operations, such as subsea drilling as described more fully hereinafter, as well as other wellbore operations, such as wellbore reentry, intervention and recompletion. Such drilling system includes tubing at the sea level. A rig at the sea level moves the tubing from the reel into and out of the wellbore. A bottom hole assembly, carrying the drill bit, is attached to the bottom end of the tubing. A wellhead assembly at the sea bottom receives the bottom hole assembly and the tubing. A drilling fluid system continuously supplies drilling fluid into the tubing, which discharges at the drill bit and returns to the wellhead equipment carrying the drill cuttings. A pump at the surface is used to pump the drilling fluid downhole. A fluid return line extending from the wellhead equipment to the surface work station transports the returning fluid to the surface.

In the preferred embodiment of the invention, an adjustable pump is provided coupled to the annulus of the well. The lift provided by the adjustable pump effectively lowers the bottom hole pressure. In an alternative embodiment of the present invention, a flowable material, whose fluid density is less than the density of the returning fluid, is injected into a return line separate and spaced from the tubing at one or more suitable locations in the return line or wellhead. The rate of injection of such lighter material can be controlled to provide additional regulation of the pressure the return line and to maintain the pressure in the wellbore at predetermined values throughout the tripping and drilling operations.

Some embodiments of the drilling system of this invention are free of subsea risers that usually extend from the wellhead equipment to the surface and carry the returning drilling fluid to the surface. Fluid flow control devices may also be provided in the return line and in the tubing. Sensors make measurements of a variety of parameters related to conditions of the return fluid in the wellbore. These measurements are used by a control system, preferably at the surface, to control the surface and adjustable pumps, the injection of low density fluid at a controlled flow rate and flow restriction devices included in the drilling system. In other embodiments of the invention, subsea risers are used as guide tubes for the tubing and a surge tank or stand pipe in communication with the return fluid in the flow of the fluid to the surface.

These features (in some instances acting individually and other instances acting in combination thereof) regulate the fluid pressure in the borehole at predetermined values during subsea downhole operations in the wellbore by operating the adjustable pump system to overcome at least a portion of the hydrostatic pressure and friction loss pressure of the return fluid. Thus, these features enable the downhole pressure to be varied through a significantly wider range of pressures than previously possible, to be adjusted far faster and more responsively than previously possible and to be adjusted for a wide range of applications (i.e., with or without risers and with coiled or jointed tubing). In addition, these features enable the bottom hole pressure to be regulated throughout the entire range of downhole subsea operations, including drilling, tripping, reentry, recompletion, logging and other intervention operations, which has not been possible earlier. Moreover, the subsea equipment necessary to effect these operational benefits can be readily deployed and operationally controlled from the surface. These advantages thus result in faster and more effective subsea downhole operations and more production from the reservoir, such as setting casing in the wellbore.

Examples of the more important features of the invention have been summarized (albeit rather broadly) in order that the detailed description thereof that follows may be better understood and in order that the contributions they represent to the art may be appreciated. There are, of course, additional features of the invention that will be described hereinafter and which will form the subject of the claims appended hereto.

BRIEF DESCRIPTION OF THE DRAWINGS

For detailed understanding of the present invention, reference should be made to the following detailed description of the preferred embodiment, taken in conjunction with the accompanying drawings, in which like elements have been given like numerals.

DETAILED DESCRIPTION OF PREFERRED EMBODIMENTS

Figure 1:
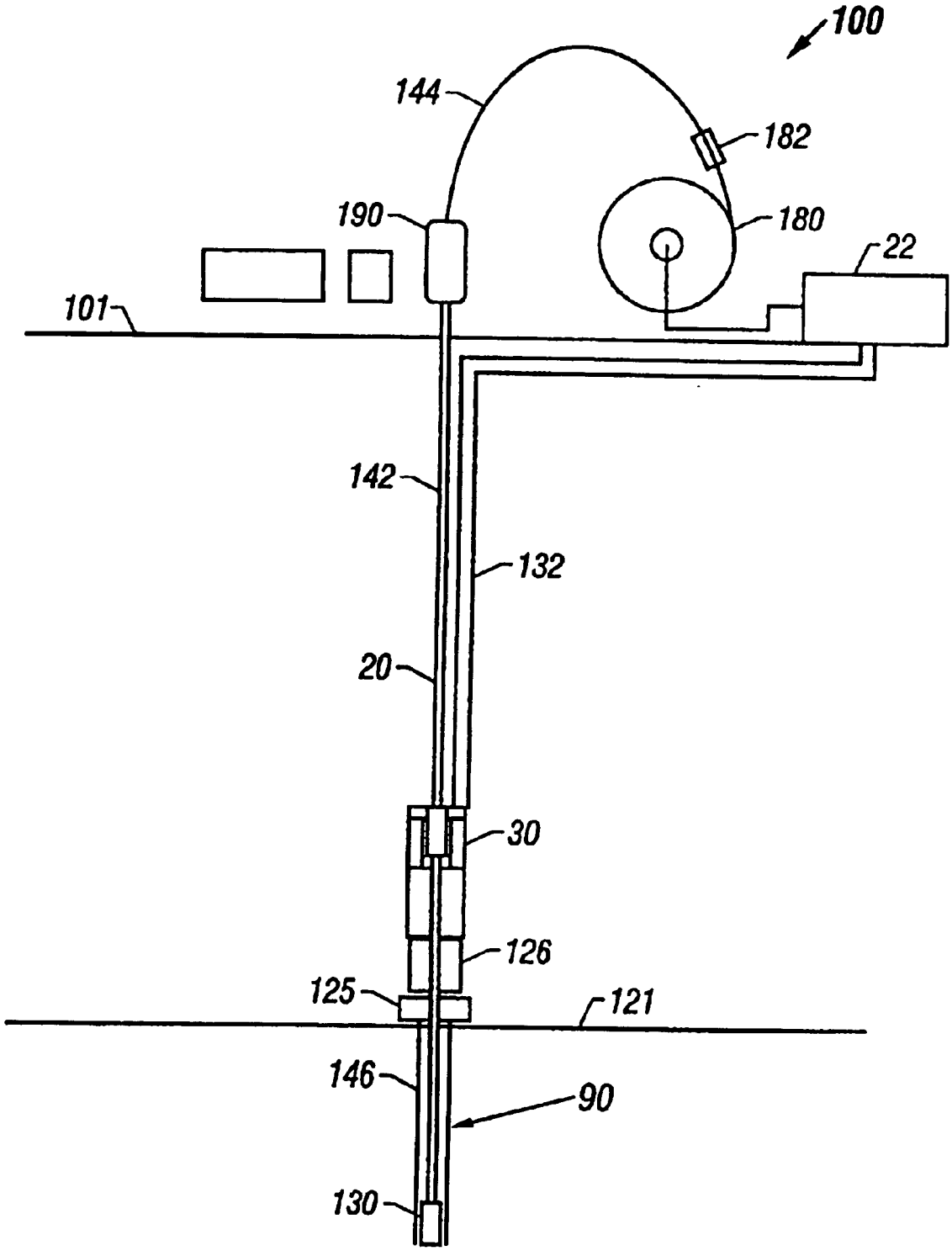
FIG. 1 is a schematic elevational view of a wellbore system for subsea downhole wellbore operations wherein fluid, such as a drilling fluid, is continuously circulated through the wellbore during drilling of the wellbore and wherein a controlled lift device is used to regulate the bottom hole ECD through a wide range of pressures.

FIG. 1 shows a schematic elevational view of a drilling system 100 for drilling subsea or under water wellbores 90. The drilling system 100 includes a drilling platform, which may be a drill ship 101 or another suitable surface work station such as a floating platform or a semi-submersible. Various types of work stations are used in the industry for drilling or performing other wellbore operations in subsea wells. A drilling ship or a floating rig is usually preferred for drilling deep water wellbores, such as wellbores drilled under several thousand feet of water. To drill a wellbore 90 under water, wellhead equipment 125 is deployed above the wellbore 90 at the sea bed or bottom 121. The wellhead equipment 125 includes a blow-out-preventer stack 126. A lubricator (not shown) with its associated flow control valves may be provided over the blow-out-preventer 126. The flow control valves associated with the lubricator control the discharge of the returning drilling fluid from the lubricator.

The subsea wellbore 90 is drilled by a drill bit carried by a drill string, which includes a drilling assembly or a bottom hole assembly ("BHA") 130 at the bottom of a suitable tubing, such as continuous tubing 142. It is contemplated that jointed tubing may also be used in the invention. The continuous tubing 142 is spooled on a reel 180, placed at the vessel 101. To drill the wellbore 90, the BHA 130 is conveyed from the vessel 101 to the wellhead equipment 125 and then inserted into the wellbore 90. The tubing 142 is moved from the reel 180 to the wellhead equipment 125 and then moved into and out of the wellbore 90 by a suitable tubing injection system. FIG. 1 shows one embodiment of a tubing injection system comprising a first or supply injector 182 for feeding a span or loop 144 of tubing to the second or main tubing injector 190. A third or subsea injector (not shown) may be used at the wellhead to facilitate injection of the tubing 142 in the wellbore 90.

Installation procedures to move the bottom hole assembly 130 into the wellbore 90 is described in U.S. Pat. No. 5,738,173, commonly assigned with this application.

The primary purpose of the injector 182 is to move the tubing 142 to the injector 190 and to provide desired tension to the tubing 142. If a subsea injector is used, then the primary purpose of the surface injector 190 is to move the tubing 142 between the reel 180 and the subsea injector. If no subsea injector is used, then the injector 190 is used to serve the purpose of the subsea injector. For the purpose of this invention any suitable tubing injection system may be utilized.

Figure 2:
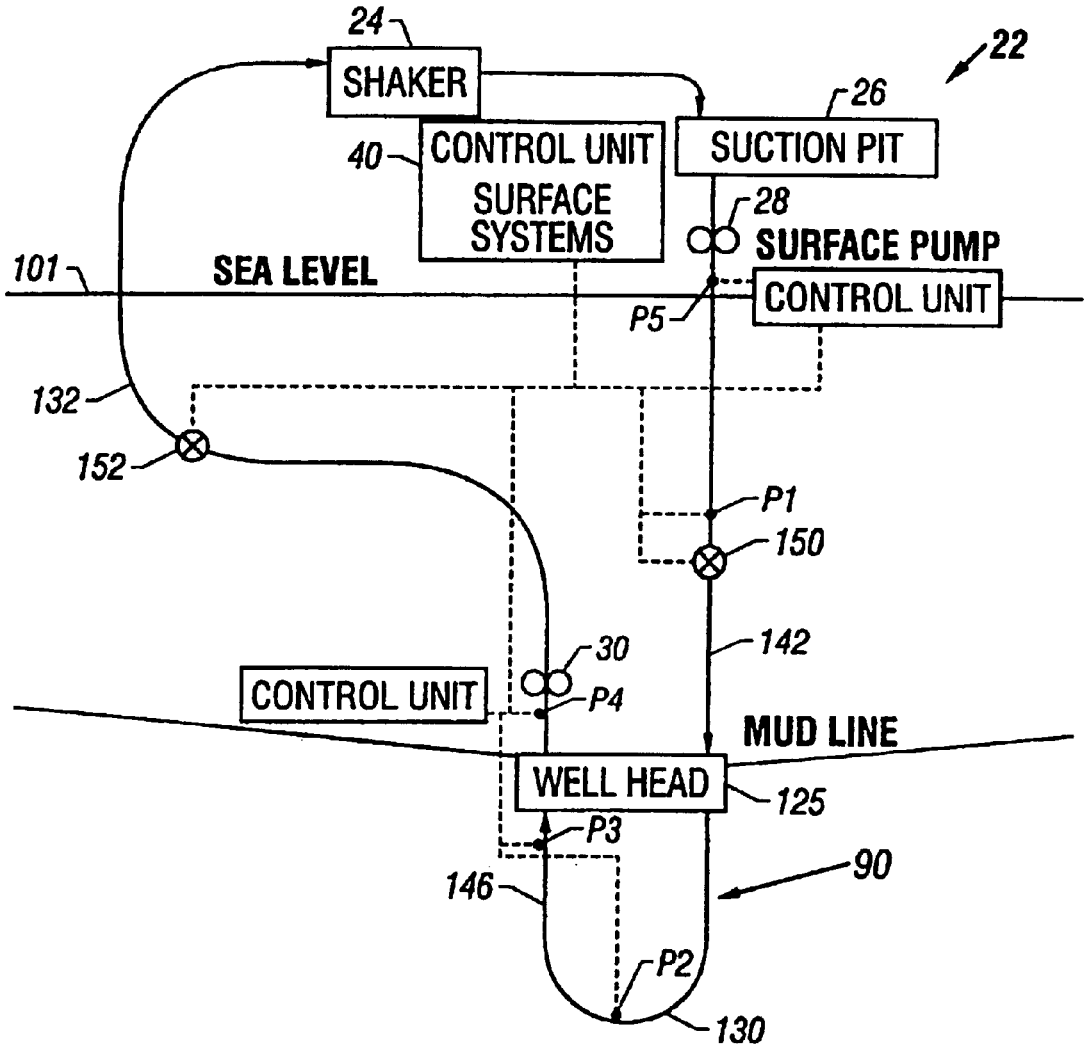
FIG. 2 is a schematic illustration of the fluid flow path for the drilling system of FIG. 1 and the placement of certain devices and sensors in the fluid path for use in controlling the pressure of the fluid in the wellbore at predetermined values and for controlling the flow of the returning fluid to the surface.

To drill the wellbore 90, a drilling fluid 20 from a surface mud system 22 (see FIG. 2, for details) is pumped under pressure down the tubing 142. The fluid 20 operates a mud motor in the BHA 130 which in turn rotates the drill bit. The drill bit disintegrates the formation (rock) into cuttings. The drilling fluid 20 leaving the drill bit travels uphole through the annulus between the drill string and the wellbore carrying the drill cuttings. A return line 132 coupled to a suitable location at the wellhead 125 carries the fluid returning from the wellbore 90 to the sea level. As shown in FIG. 2, the returning fluid discharges into a separator or shaker 24 which separates the cuttings and other solids from the returning fluid and discharges the clean fluid into the suction or mud pit 26. In the prior art methods, the tubing 142 passes through a mud filled riser disposed between the vessel and the wellhead, with the wellbore fluid returning to the surface via the riser. Thus, in the prior art system, the riser constituted an active part of the fluid circulation system. In one aspect of the present invention, a separate return line 132 is provided to primarily return the drilling fluid to the surface. The return line 132, which is usually substantially smaller than the riser, can be made from any suitable material and may be flexible. A separate return line is substantially less expensive and lighter than commonly used risers, which are large diameter jointed pipes used especially for deep water applications and impose a substantial suspended weight on the surface work station. FIG. 2 shows the fluid flow path during the drilling of a wellbore 90 according to the present invention.

In prior art pumping systems, pressure is applied to the circulating fluid at the surface by means of a positive displacement pump 28. The bottom hole pressure (BHP) can be controlled while pumping by combining this surface pump with an adjustable pump system 30 on the return path and by controlling the relative work between the two pumps. The splitting of the work also means that the size of the surface pump 28 can be reduced. Specifically, the circulating can be reduced by as much as 1000 to 3000 psi. The limit on how much the pressure can be lowered is determined by the vapor pressure of the return fluid. The suction inlet vapor pressure of the adjustable pumps 28 and 30 must remain above the vapor pressure of the fluid being pumped. In a preferred embodiment of the invention, the net suction head is two to three times the vapor pressure of the fluid to prevent local cavitation in the fluid.

More specifically, the surface pump 28 is used to control the flow rate and the adjustable pump 30 is used to control the bottom hole pressure, which in turn will affect the hydrostatic pressure. An interlinked pressure monitoring and control circuit 40 is used to ensure that the bottom hole pressure is maintained at the correct level. This pressure monitoring and control network is, in turn, used to provide the necessary information and to provide real time control of the adjustable pump 30.

Referring now to FIG. 2, the mud pit 26 at the surface is a source of drilling fluid that is pumped into the drill pipe 142 by surface pump 28. After passing through the tubing 142, the mud is used to operate the BHA 130 and returns via the annulus 146 to the wellhead 125. Together the tubing 142, annulus 146 and the return line 132 constitutes a subsea fluid circulation system.

The adjustable pump 30 in the return line provides the ability to control the bottom hole pressure during drilling of the wellbore, which is discussed below in reference to FIGS. 4A–4C. A sensor P1 measures the pressure in the drill line above an adjustable choke 150 in the tubing 142.

A sensor P2 is provided to measure the bottom hole fluid pressure and a sensor P3 is provided to measure parameters indicative of the pressure or flow rate of the fluid in the annulus 146. Above the wellhead, a sensor P4 is provided to measure parameters similar to those of P3 for the fluid in the return line and a controlled valve 152 is provided to hold fluid in the return line 132. In operation, the control unit 40 and the sensor P1 operate to gather data relating to the tubing pressure to ensure that the surface pump 28 is operating against a positive pressure, such as at sensor P5, to prevent cavitation, with the control unit 40 adjusting the choke 150 to increase the flow resistance it offers and/or to stop operation of the surface pump 28 as may be required. Similarly, the control system 40 together with sensors P2, P3 and/or P4 gather data, relative to the desired bottom hole pressure and the pressure and/or flow rate of the fluid in the return line 132 and the annulus 146, necessary to achieve a predetermined downhole pressure. More particularly, the control system acting at least in part in response to the data from sensors P2, P3 and/or P4 controls the operation of the adjustable pump 30 to provide the predetermined downhole pressure operations, such as drilling, tripping, reentry, intervention and recompletion. In addition, the control system 40 controls the operation of the fluid circulation system to prevent undesired flow of fluid within the system when the adjustable pump is not in operation. More particularly, when operation of the pumps 28, 30 is stopped a pressure differential may be resident in the fluid circulation system tending to cause fluid to flow from one part of the system to another. To prevent this undesired situation, the control system operates to close choke 150 in the tubing, valve 152 in the return line or both devices.

The adjustable pump 30 preferably comprises a centrifugal pump. Such pumps have performance curves that provide more or less a constant flow rate through the adjustable pump system 30 while allowing changes in the pressure increase of fluid in the pump. This can be done by changing the speed of operation of the pump 30, such as via a variable speed drive motor controlled by the control system 40. The pump system may also comprise a positive displacement pump provided with a fluid by-pass line for maintaining a constant flow rate through the pump system, but with control over the pressure increase at the pump. In the FIG. 2 embodiment of the invention, the adjustable pump system 30 may be used with the separate return line 132, as shown, or may be used in conjunction with the conventional mud-filled riser (not shown).

Figure 3:
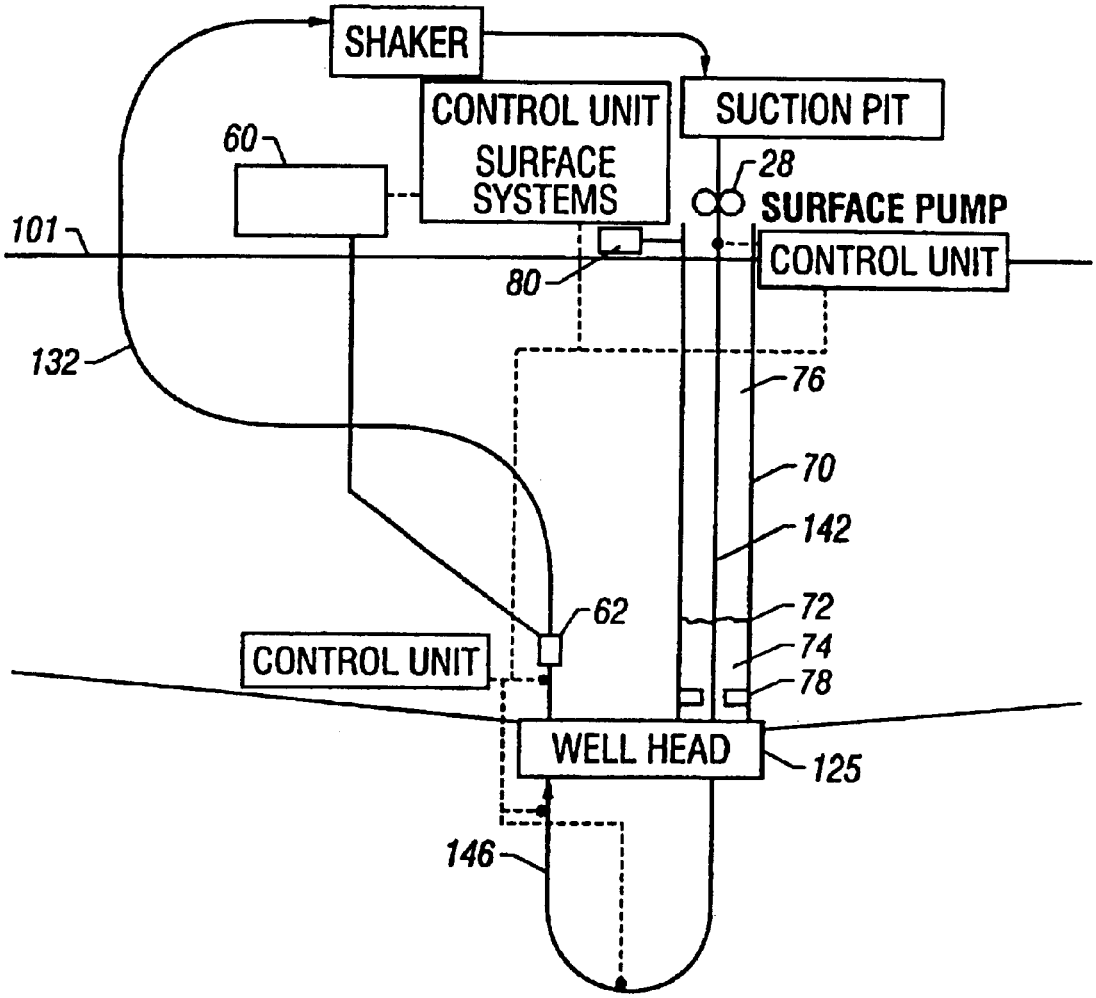
FIG. 3 is a schematic similar to FIG. 2 showing another embodiment of this invention utilizing a tubing guide tube or stand pipe as a surge tank.

FIG. 3 shows an alternative lifting system intended for use with a return line 132, such as that shown, that is separate and spaced apart from the tubing 142. In this embodiment, a flowable material of lower density than the return fluid from a suitable source 60 thereof at the surface is injected in the return fluid by a suitable injector 62 in the subsea circulation system to lift the return fluid and reduce the effective ECD and bottom hole pressure. The flowable material may be a suitable gas such as nitrogen or a suitable liquid such as water. Like the adjustable pump system 30, the injector 62 is preferably used in conjunction with sensors P1, P2, P3, P4 and/or P5 and controlled by the control system 40 to control the bottom-hole pressure. In addition, the injection system may constitute the sole lift system in the fluid circulation system, or is used in conjunction with the adjustable pump system 30 to overcome at least a portion of the hydrostatic pressure and friction loss pressure of the return fluid.

FIG. 3 also shows a tube 70 extending from the surface work station 101 down to the wellhead 125 that may be employed in the fluid circulation system of this invention. However, in contrast to the conventional mud-filled riser, the tube 70 rather serves as a guide tube for the tubing 142 and a surge tank selectively used for a limited and unique purpose as part of the fluid circulation system. More particularly the tube 70 serves to protect the tubing 142 extending through the turbulent subsea zone down to the wellhead. In addition, the tube has a remotely operated stripper valve 78 that when closed blocks fluid flow between the return line 132 and the annulus 146 and when opened provides fluid flow communication into the interior of the tubing from the return line and the annulus. Thus, with the stripper valve closed, the fluid circulation system operates in the manner described above for the FIGS. 2 and 3 embodiments of this invention, in which there is a direct correspondence of the flow rate of fluid delivered to the system by the surface pump 28 and fluid flowing past the adjustable pump system 30 or injector 62. However, in contrast to this closed system, when the stripper valve 78 is opened, an open system is created offering a unique operating flexibility for a range of pressures in the fluid circulation system at the wellhead 125 at or above sea floor hydrostatic pressure. More particularly, with the stripper valve open, the tube 70 operates as a surge tank filled in major part by sea water 76 and is also available to receive return flow of mud if the pressure in the fluid circulation system at the wellhead 125 is at a pressure equal to or greater than sea floor hydrostatic pressure. At such pressures, the mud/water 72 rises with the height of the column 74 adjusting in response to the pressure changes in the fluid circulation system. This change in the mud column also permits the flow rate of the fluid established by the adjustable pump system 30 or injector 62 to differ from that of the surface pump 28. This surge capacity provides time for the system to adjust to pump rate mismatches that may occur in the system and to do so in a self-adjusting manner. Further critical pressure downhole measurements of the fluid circulation system may be taken at the surface via the guide tube 70. More particularly, as the height of the mud column 74 changes, the column of water 76 is discharged (or refilled) at the surface work station 101. Measuring this surface flow of water such as at a suitable flowmeter 80 provides a convenient measure of the pressure of the return fluid at the wellhead 125.

Figure 4A:
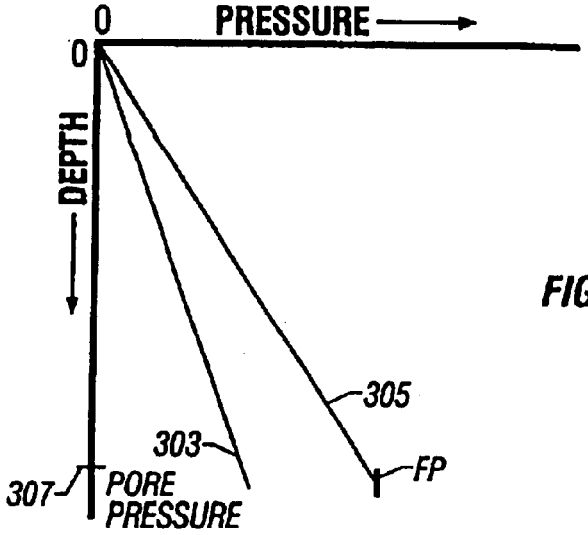
FIGS. 4A–4C illustrate the pressure profiles obtained by using the present invention compared to prior art pressure profiles.
Figure 4B:
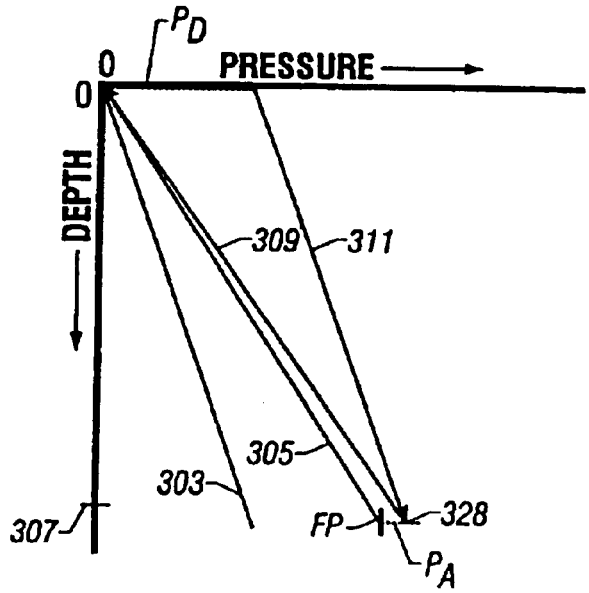
Figure 4C:
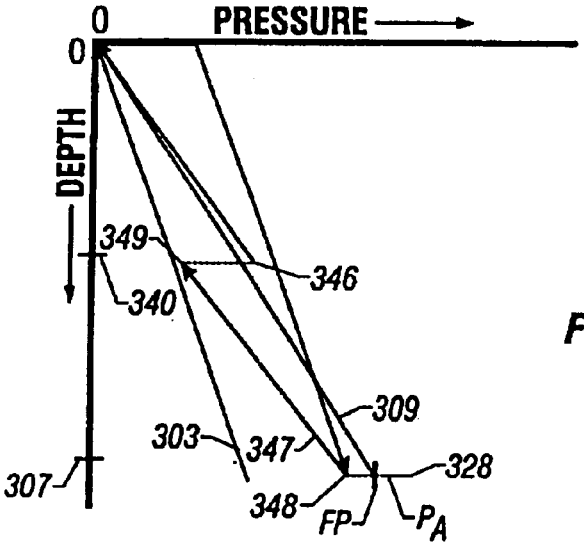

The use of the adjustable pump 30 (or controlled injector 62) is discussed now with reference to FIGS. 4A–4C. FIG. 4A shows a plot of static pressure (abscissa) against subsea and then wellbore depth (ordinate) at a well. The pore pressure of the formation in a normally pressured rock is given by the line 303. Typically drilling mud that has a higher density than water is used in the borehole to prevent an underbalanced condition leading to blow-out of formation fluid. The pressure inside the borehole is represented by 305. However, when the borehole pressure 305 exceeds the fracture pressure FP of the formation, which occurs at the depth 307, further drilling below depth 307 using the mud weight corresponding to 305 is no longer possible.

With conventional fluid circulation systems, either the density of the drilling mud must be decreased and the entire quantity of heavy drilling mud displaced from the circulation system, which is a time consuming and costly process, or a steel casing must be set in the bottom of the wellbore 307, which is also time consuming and costly if required more often than called for in the wellbore plan. Moreover, early setting of casing causes the well to telescope down to smaller diameters (and hence to lower production capacity) than otherwise desirable.

FIG. 4B shows dynamic pressure conditions when mud is flowing in the borehole. Due to frictional losses due to flow in the drillsting, shown at line $P_D$, and in the annulus, shown at line $P_A$, the pressure at a depth 307 is given by a value 328, i.e., defining an effective circulating density (ECD) by the pressure gradient line 309. The pressure at the bottom of the hole 328 exceeds the static fluid hydrostatic pressure 305 by an additional amount over and above the fracture pressure FP shown in FIG. 4A. This excess pressure $P_A$ is essentially equal to the frictional loss in the annulus for the return flow. Therefore, even with drilling fluid of lower density than that for gradient line 305 circulating in the circulation system, a well cannot be drilled to the depth indicated by 307. With enough pressure drop due to fluid friction loss, drilling beyond the depth 307 may not be possible even using only water.

Prior art methods using the dual density approach seek to reduce the effective borehole fluid pressure gradient by reducing the density of the fluid in the return line. It also illustrates one of the problems with relying solely upon density manipulation for control of bottom hole pressure. Referring to FIG. 4B, if circulation of drilling mud is stopped, there are no frictional losses and the effective fluid pressure gradient immediately changes to the value given by the hydrostatic pressure 305 reflecting the density of the drilling fluid. There maybe the risk of losing control of the well if the hydrostatic pressure is not then somewhat above the pore pressure in order to avoid an inrush of formation fluids into the borehole. Pressure gradient line 311 represents the fluid pressure in the drilling string.

FIG. 4C illustrates the effect of having a controlled lifting device (i.e., pump 30 or injector 62) at a depth 340. The depth 340 could be at the sea floor or lower in the wellbore itself. The pressure profile 309 corresponds to the same mud weight and friction loss as 309 in FIG. 4B. At the depth corresponding to 340, a controlled lifting device is used to reduce the annular pressure from 346 to 349. The wellbore and the pressure profile now follow pressure gradient line 347 and give a bottom hole pressure of 348, which is below the fracture pressure FP of the formation. Thus, by use of the present invention, it is possible to drill down to and beyond the depth 307 using conventional drilling mud, whereas with prior art techniques shown in FIG. 4C it would not have been possible to do so even with a drilling fluid of reduced density.

There are a number of advantages of this invention that are evident. As noted above, it is possible to use heavier mud, typically with densities of 8 to 18 lbs. per gallon for drilling: the heavier weight mud provides lubrication and is also better able to bring up cuttings to the surface. The present invention makes it possible to drill to greater depths using heavier weight mud. Prior art techniques that relied on changing the mud weight by addition of light-weight components take several hours to adjust the bottom hole pressure, whereas the present invention can do so almost instantaneously. The quick response also makes it easier to control the bottom hole pressure when a kick is detected, whereas with prior art techniques, there would have been a dangerous period during which the control of the well could have been lost while the mud weight is being adjusted. The ability to fine-tune the bottom hole pressure also means that there is a reduced risk of formation damage and allow the wellbore to be drilled and casing set in accordance with the wellbore plan.

While the foregoing disclosure is directed to the preferred embodiments of the invention, various modifications will be apparent to those skilled in the art. It is intended that all variations within the scope and spirit of the appended claims be embraced by the foregoing disclosure.

What is claimed is:

1. A wellbore system for forming a wellbore in a formation, comprising:

(a) a drill string having a drill bit at an end thereof for disintegrating a formation;

(b) a fluid system supplying fluid under pressure to the drill bit via the drill string, the fluid returning via an annulus of the wellbore; and (c) a pump coupled to the annulus of the wellbore for reducing the pressure of the fluid in the annulus, the pump controlling the fluid pressure in the annulus at a predetermined pressure.

2. The system according to claim 1 wherein the predetermined pressure is greater than a formation pore pressure.

3. The system according to claim 1 wherein the predetermined pressure is greater than a formation pore pressure and less than a formation fracture pressure.

4. The system according to claim 1 wherein the pump is one of a centrifugal pump and a positive displacement pump.

5. The system according to claim 1 further comprising a fluid bypass associated with the pump.

6. The system according to claim 1 further comprising one of a choke and a valve associated with the fluid system to prevent undesired flow of fluid when the pump is not operating.

7. A method for forming a wellbore in a formation, comprising:

(a) providing a drill string having a drill bit at an end thereof for disintegrating a formation;

(b) supplying fluid under pressure with a fluid system to the drill bit via the drill string, the fluid returning via an annulus of the wellbore; and (c) controlling the fluid pressure in the annulus to provide a predetermined pressure using a pump coupled to the annulus of the wellbore.

8. The method according to claim 7 further comprising providing a plot of a pore pressure of the formation; and wherein the fluid pressure is controlled relative to the pore pressure.

9. The method according to claim 7 wherein the predetermined pressure is greater than a formation pore pressure.

10. The method according to claim 7 wherein the predetermined pressure is greater than a formation pore pressure and less than a formation fracture pressure.

11. The method according to claim 7 wherein the pump is one of a centrifugal pump and a positive displacement pump.

12. The method according to claim 7 further comprising maintaining a constant flow rate at the pump using a fluid.

13. The method according to claim 7 further comprising preventing undesired flow of fluid when the pump is not operating using one of a choke and a valve.

14. The method according to claim 7 wherein the pump is positioned at a depth in the wellbore; and further comprising operating the pump such that the fluid pressure below the pump is lower than the fluid pressure above the pump.

* * * * *